United States Patent [19]

Puccio et al.

[11] 4,339,214

[45] Jul. 13, 1982

[54] COMPOSITE EXPANSION JOINT

[75] Inventors: Guy S. Puccio, Snyder; Robert J. Kogutek, Williamsville, both of N.Y.

[73] Assignee: Acme Highway Products Corporation, Amherst, N.Y.

[21] Appl. No.: 145,993

[22] Filed: May 2, 1980

[51] Int. Cl.[3] ..... E01C 11/04

[52] U.S. Cl. ..... 404/69; 404/57; 14/16.5; 52/396

[58] Field of Search ..... 404/69, 59, 53, 57, 404/68; 14/16.5; 52/396

[56] References Cited

U.S. PATENT DOCUMENTS

| | | | |
|---|---|---|---|
| 3,430,544 | 3/1969 | Berks | 404/59 X |
| 3,482,492 | 12/1969 | Bowman | 14/16.5 X |
| 3,604,322 | 9/1971 | Koster | 404/53 |
| 3,606,826 | 9/1971 | Bowman | 404/69 X |
| 3,698,292 | 10/1972 | Koester | 14/16.5 X |
| 3,699,853 | 10/1972 | Wicks | 404/59 X |
| 3,732,021 | 5/1973 | Rizza | 14/16.5 X |
| 3,830,583 | 8/1974 | Becht | 404/69 |
| 3,880,540 | 4/1975 | Rizza | 404/69 |
| 3,904,303 | 9/1975 | Becht | 14/16.5 X |
| 4,018,539 | 4/1977 | Puccio | 404/69 |
| 4,058,867 | 11/1977 | Puccio | 404/69 X |
| 4,067,660 | 1/1978 | Puccio | 404/69 |
| 4,087,191 | 5/1978 | Brady | 404/69 |
| 4,120,066 | 10/1978 | Leroux | 404/69 X |

*Primary Examiner*—Nile C. Byers, Jr.

*Attorney, Agent, or Firm*—Christel, Bean & Linihan

[57] ABSTRACT

A composite expansion joint assembly having a pair of edge members, a plurality of elongated resiliently yieldable sealing elements, rigid structural members interposed between adjacent sealing elements and laterally spaced support bars for the structural members. Equalizing springs acting directly upon the structural members independently of the support bars are compressed by movement of the structural members away from each other and from the edge members as the sealing members open, providing equalizing forces to maintain equidistant spacing between the structural members whether they are laterally slidable on the support bars in a single support bar system or are fixed to the support bars in a multiple support bar system.

10 Claims, 7 Drawing Figures

COMPOSITE EXPANSION JOINT

BACKGROUND OF THE INVENTION

This invention is directed to composite expansion joint systems of the type used to seal expansion grooves between bridge deck sections and the like. Such expansion joint systems typically comprise an assembly of end dams or edge members, resiliently yieldable sealing elements extending longitudinally of the groove in side by side relation, transverse sectional dividers in the form of cross beam structural members interposed between adjacent sealing elements, and underlying support bars extending transversely of the groove and supporting the cross beam structural members. Customarily such joints incorporate either a single support bar system, as exemplified by U.S. Pat. No. 3,482,492, wherein the cross beams all rest on the same support bar at each location and are laterally slidable thereon during expansion and contraction, or an individual or multiple support bar system. The latter is characterized by the provision of a support bar for each cross beam, with only one cross beam bearing on any one support bar, at each location, and each cross beam being fixed to its support bar for movement therewith. Such a system is shown in U.S. Pat. No. 3,604,322.

It is desirable to maintain equidistant spacing between adjacent cross beam structural members and between the end members and the adjacent cross beam structural members, throughout the range of movement contemplated for the joint. This results in an even load distribution, provides uniformity across the joint and avoids unequal stressing of the seal members and of the interlock between the seal members and adjacent beams and edge members. The individual sealing elements are either under compression at all times and therefore exert centering forces on the beams, or may be disposed between adjacent beams and edge members by means of locking lugs so that in the open position little or no forces are exerted by the sealing elements on the system. However, as the bridge deck moves, either by expanding or contracting, it is desirable to maintain equidistant spacing of the cross beams and edge members so as to eliminate the possibility of pulling a sealing member out or of having an esthetically unpleasing arrangement of these members. Therefore it is desirable to supplement the centering action of the sealing elements, or lack thereof, preferably in a manner compensating for the variation in forces exerted by the sealing elements especially during the opening movement.

U.S. Pat. No. 3,430,544 discloses a device for sealing expansion joints in bridge decking including a T-shaped plate having arms sandwiched between layers of neoprene at opposite sides of the joint, and a leg fixed to the arms and projecting upwardly between the decking slabs in the manner of a cross beam. The spaces between the side faces of the leg and the edges of the joint are filled by compressed neoprene which expands when the joint opens. The layers of neoprene at opposite ends of the arms are vertically compressed against the arms which cause these layers to be distorted as the joint opens. U.S. Pat. No. 3,604,322 discloses cross beams interposed between sealing elements and fixed to support bars in an individual support bar system. Elastic elements are vertically compressed against the opposite ends of the support bars, to exert centering forces thereon. In other embodiments, compression springs are positioned between adjacent support bars in a manner exerting centering forces thereon. However, both of these prior art arrangements are applicable only to multiple support bar systems or to expansion joints of the individual support bar type, wherein the cross beams are rigidly connected to the support bars for lateral movement therewith, because the centering forces applied to the support bars would have no effect on cross beams which are laterally slidable on the support bars as in the single support bar system described above.

SUMMARY OF THE INVENTION

The primary object of this invention is to provide a composite expansion joint equalizing spring arrangement exerting increasing centering forces on the cross beams as the interposed resilient sealing elements of the joint open, doing so independently of the underlying support bars and therefore operable in single support bar systems as well as in systems of the multiple support bar type.

Another object of this invention is to provide the foregoing in an arrangement which is durable and dependable in operation, offers flexibility in design of a particular joint, and which is reasonable in cost so as to be a practical solution for the intended purpose.

The foregoing and other objects, advantages and characterizing features of this invention will become apparent from the ensuing detailed description of certain illustrative embodiments, taken together with the accompanying drawings wherein like reference numerals denote like parts throughout the various views.

BRIEF DESCRIPTION OF THE DRAWING FIGURES

Figure 2:
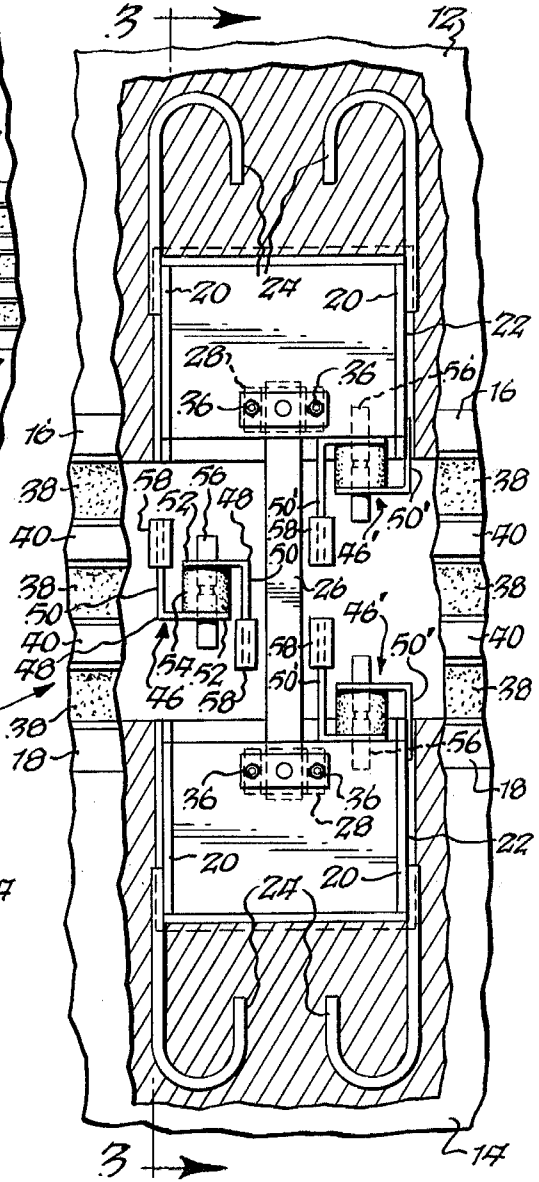
FIG. 2 is a fragmentary plan view thereof, on an enlarged scale, with parts broken away to illustrate certain details with greater clarity.
Figure 1:
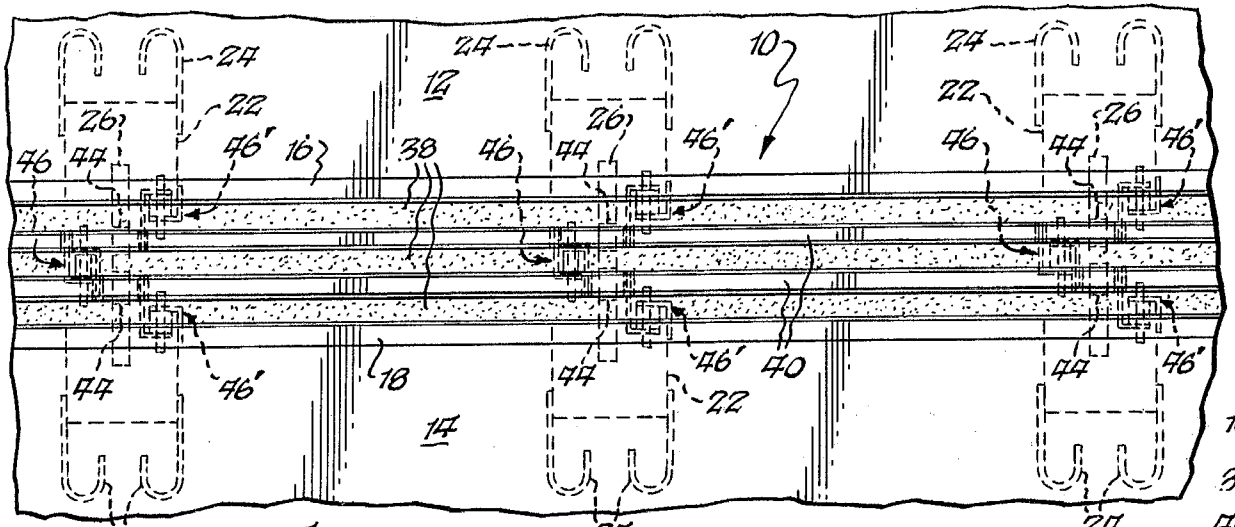
FIG. 1 is a top plan view of an equalizing spring arrangement of this invention in a composite expansion joint assembly incorporating a single support bar system, broken away to indicate indeterminate length and for convenience in illustration.
Figure 5:
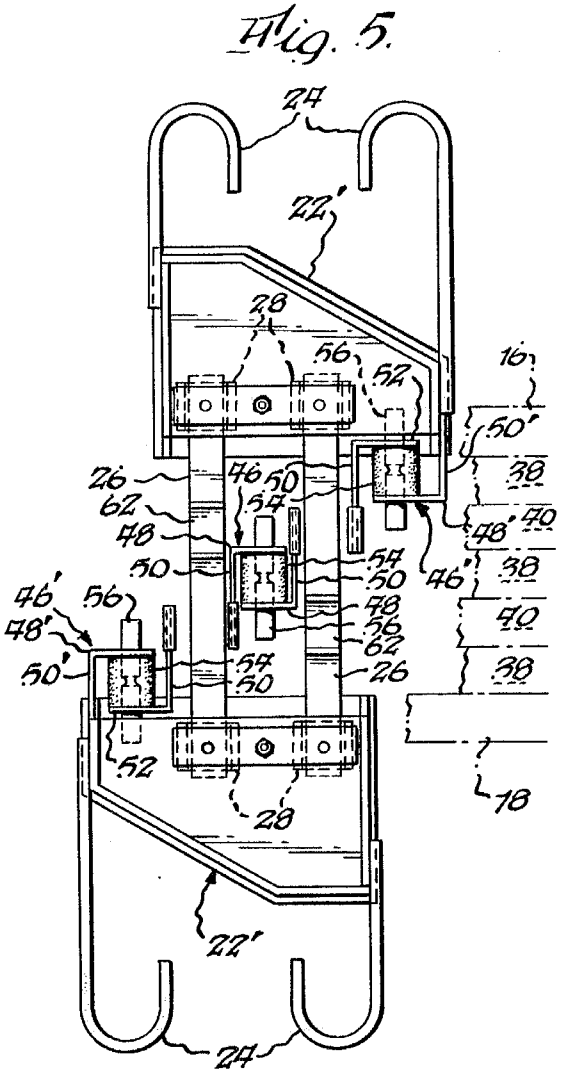
FIG. 5 is a fragmentary plan view, with parts broken away to show details, similar to FIG. 2 but showing an equalizing spring arrangement of this invention in a composite expansion joint assembly incorporating an individual or multiple support bar system.
Figure 6:
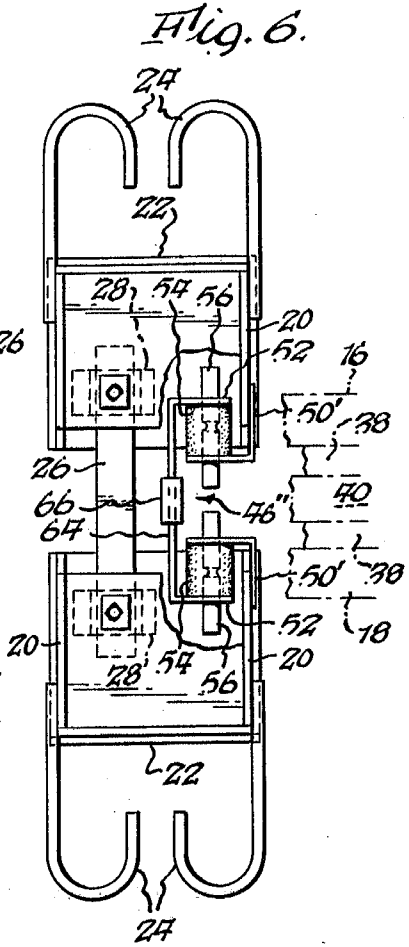
Figure 7:
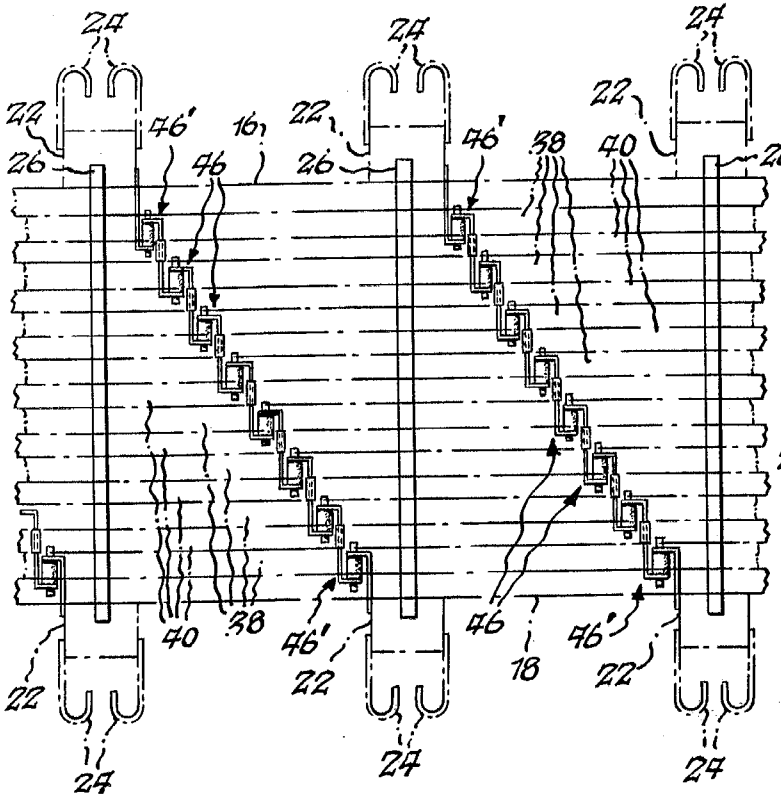

FIG. 6 is a view similar to that of FIGS. 2 and 5, but showing an equalizing spring arrangement of this invention in a composite expansion joint assembly utilizing either a single support bar system or an individual support bar system; and FIG. 7 is a view similar to that of FIG. 1, but showing an equalizing spring arrangement of this invention in a composite expansion joint assembly having a much larger number of seal and structural members, in a single support bar system.

DETAILED DESCRIPTION OF THE ILLUSTRATED EMBODIMENTS

Figure 3:
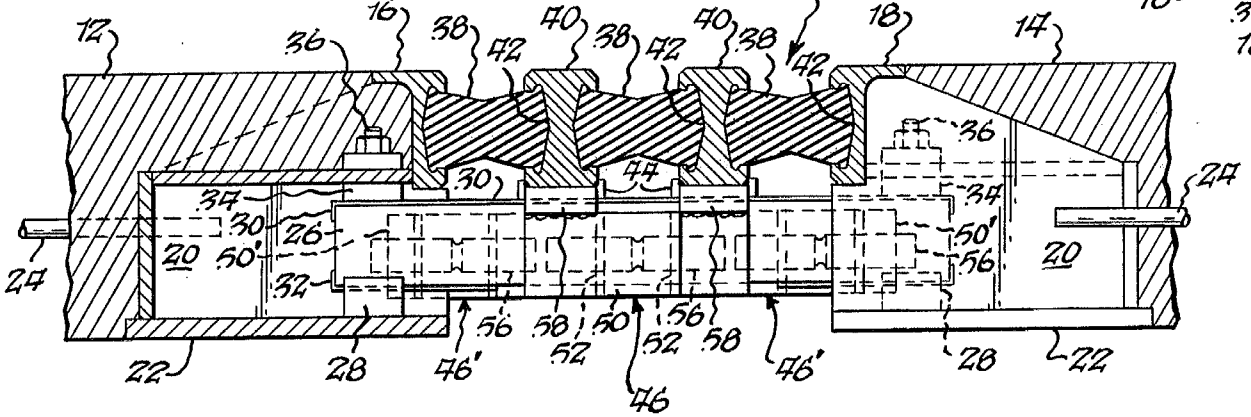
FIG. 3 is a transverse sectional view thereof, taken about on line 3—3 of FIG. 2.

There is shown in FIGS. 1–3 a composite expansion joint assembly, generally designated 10, installed in an expansion groove between adjacent bridge deck slabs or sections 12 and 14 which are formed of reinforced concrete or other suitable material.

The joint assembly 10 includes a pair of edge members 16, 18 in the form of end dams, the upper surfaces of which are even with the roadway surface of bridge deck sections 12 and 14, respectively, the members 16, 18 defining the opposite sides of the expansion groove. Members 16, 18 are secured to bridge sections 12, 14 in a conventional manner, including stiffener plates 20 embedded in the concrete of the deck sections and positioned at spaced points therealong on top of support bar boxes 22 of generally rectangular configuration. Boxes 22 are of typical construction and secured in the bridge deck concrete as by rebars 24 in a manner well understood in this art.

Support bar boxes 22 face each other on opposite sides of the gap, opening into the gap, and are arranged at spaced locations therealong to receive support bars 26. A single support bar 26 is provided at each location, the opposite ends of each bar 26 being slidably supported on bearing blocks 28 of steel, polyurethane or other suitable material. Support bars 26 are provided with a stainless steel sliding surface 30 on their top surface, and with similar surfaces 32 on their bottom surface at opposite ends thereof. Pressure pad assemblies 34 hold support bars 26 down, in sliding engagement with bearing members 28, each pressure pad assembly having an adjusting set screw arrangement 36.

The expansion groove is spanned by a plurality of elongated, resiliently yieldable sealing elements 38 extending longitudinally of the groove in side by side parallel relation. Transverse sectional dividers in the form of elongated, rigid load distribution structural members 40 are interposed between adjacent sealing elements 38. The members 40, are cross beams, in the nature of modified I-beams or specially extruded shapes, the opposite faces of which are especially configured to provide cavities 42 shaped to receive and retain the opposite side of sealing elements 38, and the opposing faces of end members 16, 18 are similarly configured. The arrangement of sealing elements and retaining members is like that illustrated and described in U.S. Pat. No. 4,018,539, having a common assignee with this application, to which reference is made for any further detailed description.

The expansion joint assembly of FIGS. 1–3 uses a single support bar system. That is to say, there is only one support bar 26 at each location, and all of the members 40 are supported on the single bar 26, at each location, for lateral sliding movement relative thereto. To facilitate such sliding a clip 44 is secured to the bottom of each member 40 at each support bar location. Clips 44 have a fluorocarbon face bonded thereto which ride on sliding surface 30 for supporting the member 40 in sliding engagement with each support bar 26.

Such general arrangement of sealing elements, support bars and laterally slidable divider members supported thereby are known, being shown for example in U.S. Pat. No. 4,058,867 to which reference is made for any further detailed description, and dividers 40 can be provided with uplift restraints (not shown) if desired, as shown in said patent.

In operation, upon contraction of bridge deck sections 12 and 14 the expansion groove opens or enlarges, and this is accommodated by the compressed sealing elements 38 which resiliently expand to fill the enlarged groove. Conversely, when sections 12 and 14 expand, the expansion groove closes or shrinks, and this is accommodated by the sealing elements 38 which are thereupon further compressed, resiliently yielding to permit structural members 40 to move toward each other and toward end members 16, 18. In all of this, uniformity of action and lateral distribution of the load is desirable, with expansion and contraction of the joint assembly being equally divided among the joint components and the members 40 equally spaced across the joint, throughout the range of movement.

This is accomplished in the instant invention by providing equalizing springs arranged between adjacent members 40, and between said membes 16, 18 and the adjacent members 40, to directly act upon members 40 in a manner maintaining them equidistant from each other and from edge members 16, 18 throughout the range of movement of the joint, even as they move laterally relative to the underlying support bars in the single support bar system shown in FIGS. 1–3.

The equalizing springs are generally designated 46 and comprise paired spring brackets 48 of L shape, having legs 50 extending in opposite directions transversely of the groove and connected to adjacent members 40, and legs 52 extending lengthwise of the groove in spaced apart, opposing relation and receiving a compression spring member 54 positioned therebetween. Spring member 54 is of suitable resiliently yieldable material, for example microcellular urethane, and is carried by a dowel 56 of nylon or other suitable material which extends through a central bore in spring member 54, and through opposed holes in legs 52. Spring members 54 can be cylindrical or flat sided, and while solid springs of resiliently yieldable material are shown, springs of other constructions and having the requisite characteristics can be used.

It is a particular feature of this invention that the compensating centering springs 46 are carried by the cross beam structural members 40, and directly exert centering forces thereon. To avoid interference with the adjacent member 40, springs 46 are positioned in spaced relation below the members 40. This can be accomplished by forming the outer end portion of leg 50 so that it extends upwardly above the remainder of the spring for connection to the structural member 40. Such special forming can be avoided, however, by the use of spacer bar members 58 which are welded to the underside of members 40, and to the upper edge of bracket leg 50, thereby permitting the use of standard metal angles for brackets 48. In this manner, the spring brackets are maintained in spaced relation below the structural members adjacent to the ones to which they are attached, to avoid interference, and the spring brackets are attached to the structural members 40 in spaced relation to support bar 26, sufficient to accommodate any uplift restraints or other associated mechanisms.

An equalizing spring 46' is positioned between each structural member 40 and the adjacent edge of the groove, the springs 46' being identical with the springs 46 except that in the former the bracket leg 50' secured to member 40 is slightly elongated to position the spring element 54 partially within box 22, the other spring bracket arm 50' being secured to one of the structural plates forming the support bar box 22.

The operation of the three equalizing springs 46, 46' in the embodiment of FIGS. 1–3 is as follows. Upon contraction of bridge deck sections 12 and 14, enlarging the expansion groove, sealing elements 38 expand with the groove. To remain equidistantly spaced, elements 40 must move apart from each other and from the edge member 16, such movement being in the expansion direction of the groove and the sealing members 38. However, as structural members 40 move apart they move brackets 48 of spring 46 with them, thereby moving bracket arms 52 toward each other and compressing the spring element 54.

In like manner, as the joint opens, structural members 40 and the edges of the groove move apart, carrying with them the bracket arms 50', thereby causing elements 54 of springs 46' to be compressed. Therefore, between each pair of structural elements 40, and between structural elements 40 and end members 16, 18 are equalizing springs 46, 46' which are compressed as the joint expands. As they are compressed, springs 46, 46' exert increasing centering forces on members 40, compensating for the decreasing force exerted by the sealing elements 38 as they open, and providing centering forces when little or no such forces are provided by the sealing elements, for example when using strip seals such as disclosed in U.S. Pat. No. 4,067,660. The equalizing springs 46, 46' therefore act against the structural members 40 themselves, in direct opposition to sealing elements 38, to maintain equal spacing of members 40 across the joint even as sealing elements 38 become less effective, or have little or no effect, for this purpose. Conversely, when the bridge sections expand the joint contracts, and the equalizing springs 46, 46' continue to exert centering forces on beams 40 to maintain the desired equidistant spacing.

Figure 4:
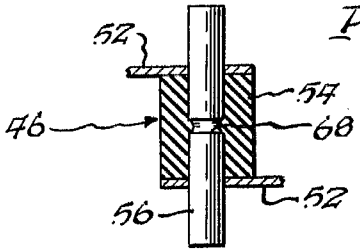
FIG. 4 is a fragmentary longitudinal sectional view of an equalizer spring used with this invention, the supporting dowel being shown in elevation.

It will be noted from FIG. 4 that dowel 56 is provided with a central peripheral recess or groove 68, into which the material of spring element 54 expands, thereby releasably releasing retaining the spring element centered on the dowel. At the same time, the dowel ends project beyond the spring element, through openings in the bracket arms 52, thereby permitting relative movement between arms 52 and dowel 56 as the spring member is compressed and permitted to expand.

It is a particular feature of this invention that the equalizing springs 46, 46' are carried by the structural members 40, and exert centering forces thereon independently of the support bars 26. Unlike the above-noted prior art arrangements, this permits the use of a single support bar system where the structural members 40 slide laterally on the support bars 26, because the equalizing action is not in any way dependent upon the support bars but is totally independent thereof with both the sealing elements 38 and the equalizing springs 46, 46' acting directly upon the cross beam members 40.

Single support bar systems have several advantages over individual or multi support bar systems where there must be a support bar 26 at each location for each of the structural members 40. This is perhaps best illustrated by looking at the eight element joint of FIG. 7 in which a total of seven structural member dividiers 40 are supported by the same underlying support bar 26 at each location. Each support bar 26 has a contact area at each end, and a contact area for each structural member 40, providing a total of nine contact areas of each support bar location. In an individual or multi support bar system there would have to be seven support bars at each location, one for each structural member 40, and those seven support bars would have a contact area at each end for a total of fourteen contact areas instead of the nine provided in the individual support system illustrated. Therefore, in large movement joints a single support bar system has fewer movement contact areas where parts can wear or loosen.

Also, the presence of only one support bar at each location permits a much smaller blockout for the support bar box. The larger the box, the less concrete there is for the bridge deck section immediately adjacent the joint. The smaller the box, the more concrete is available and the stronger the joint.

Another advantage of the equalizng spring arrangement of this invention is that it permits flexibility in positioning the equalizing springs 46, 46' which are not required to be placed at the support bar locations. This is graphically illustrated in FIG. 7 where the equalizing springs are spaced apart between support bar locations, whereas in FIG. 1 the three springs 46, 46' are positioned at the support bar location.

While the equalizing spring arrangement of this invention is particularly advantageous in permitting the use of single support bar systems, it is not limited thereto but also can be used with individual or multiple support bar systems. This is shown in FIG. 5 where, a pair of support bars 26 are provided at each location, one for each structural member 40. Support box 22' is laterally enlarged to accomodate the two support bars 26 which are spaced apart lengthwise of the joint and, as before, are slidably supported on bearings 28 at their opposite ends and held down by adjustable pressure pad assemblies. In this arrangement, one structural member 40 is fixed to one support bar 26, for example by welding to a spacer bar 62 welded on the support bar, and the other member 40 is similarly fixed to the other support bar 26. However, the equalizer springs 46, 46' are arranged and function as before. That is to say, they are carried by, and act directly upon, the members 40. One arm 50 or 50' of each spring is secured to a member 40, while the other arm 50 or 50' is secured to the other member 40, or to the support bar box 22' at opposite sides of the expansion groove, as the case may be. When the joint expands, causing sealing elements 38 to expand and exert decreasing centering forces on structural members 40, the spring bracket arms 52 are moved by structural members 40 toward each other, compressing the interposed spring elements 54 which therefore exert increasing centering force against structural members 40. As the force exerted against structural members 40 by sealing elements 38 decreases, the force exerted against those same members by the spring elements 54 increases, and vice versa, the one spring arrangement compensating for the other in a manner maintaining the desired equidistant spacing of structural members 40 across the joint, directly and without regard to the underlying support bars 26.

The embodiment shown in FIG. 6 is a two element joint, with a single dividing or separating structural member 40 which can either slide laterally on support bar 26, like members 40 in the embodiment of FIGS. 1–3, or can be fixed to support bar 26 in the manner of elements 40 in the embodiment of FIG. 5. It is a matter of choice, the equalizing spring arrangement being independent of the support bar and operating the same and equally well either way. The equalizing spring, generally designated 46', has two spring elements 54, each having a dowel 56 projecting therethrough and through openings in arms 52 of a spring support bracket. However, in this case, each spring has only one bracket like that shown at 48, 48' in the embodiment of FIGS. 2 and 5. The other arms 52 are formed at opposite ends of a U-shaped bracket 64 which is secured at its midportion 66 to the structural member 40 as by an interposed spacer 58. Thus, the two spring elements are tied together by the common spring bracket 64. However, the action is the same as before. As the joint expands, increasing the spacing between structural member 40 and edge members 16, 18, spring elements 54 are compressed because on one side they are fixed to the edges of the bridge sections and on the other side they are fixed to structural member 40. Therefore, elements 54 exert increasing force upon structural member 40 as they are compressed, compensating for the decreasing force exerted by sealing members 38 upon structural member 40 as they expand. Conversely, when the bridge sections expand it is the sealing elements 38 which are compressed and exert increasing force against the interposed structural member 40, while the equalizing spring elements 54 expand and exert decreasing force on structural member 40. This occurs whether member 40 is laterally slidable on or fixed to support bar 26.

The embodiment of FIG. 7 is like that of FIG. 1, except that it is an eight element seal and graphically illustrates the advantages resulting from the equalizing spring arrangement of this invention wherein the equalizing springs are connected to the structural members and act thereon independently of the underlying support bars. In this instance only one support bar is required, instead of seven, one for each member, permitting a smaller support bar box with a minimum of blockout, and permitting the equalizing springs to be positioned between the support bar locations instead of requiring their positioning at a support bar cluster.

Therefore, it is seen that the instant invention fully accomplishes its intended objects, providing a composite expansion joint equalizing spring arrangement of great versatility. It is not limited to a particular support bar system, and it does not require placement of the equalizer springs at the support bar locations, thereby permitting a large measure of flexibility in expansion joint selection and design. When the sealing elements are compression seals, the equalizing springs compensate for variation in the centering force exerted by the sealing elements as they open and close. When the sealing elements exert little or no centering forces, as in the case of strip seals, the equalizing springs provide the centering forces necessary to maintain equal spacing and, because they operate directly opposite to opening and closing of the sealing elements, the equalizing springs effectively resist overopening tending to pull the seals apart from the beams. While selected embodiments have been depicted and described in detail, that has been done by way of illustration, it being intended that the scope of the invention be defined by the appended claims.

What is claimed is:

1. In a composite expansion joint assembly for a bridge roadway and the like, said joint being of the type having a pair of edge members adapted to define the opposite sides of an expansion groove, a plurality of elongated, spaced, resiliently yieldable sealing elements extending longitudinally of said groove in side-by-side relation, at least one elongated, rigid structural member interposed between and separating adjacent sealing elements, and laterally spaced support bars extending transversely of said groove and underlying and supporting said structural members, said sealing elements being adapted to resiliently expand and compress upon expansion and contraction, respectively of the joint, the improvement which comprises equalizing spring means connected to and spanning the space between adjacent structural members, said equalizing spring means being adapted to compress and expand upon expansion and contraction, respectively, of the joint for urging the structural members away from each other upon expansion of the joint and for urging the structural members toward each other upon contraction of the joint in a manner maintaining substantially equidistant spacing therebetween, said equalizing spring means exerting centering forces upon each structural member independently of said support bars and positioned in underlying relationship to said structural members and between and adjacent to said support bars.

2. A composite expansion joint system as set forth in claim 1, wherein each structural member is fixed to one of said support bars in an individual support bar system.

3. A composite expansion joint assembly as set forth in claim 1, wherein there are at least three sealing elements and at least two interposed structural members and wherein said equalizing spring means comprises an equalizing spring connected to and extending between each adjacent pair of structural members, and an equalizing spring connected to and extending between the opposite edges of the groove and the adjacent structural member.

4. A composite expansion joint assembly as set forth in claim 3, each of said equalizing spring means comprising a resiliently yieldable spring member positioned between and secured to each of a pair of spring brackets, said brackets extending between adjacent structural members and connected thereto for movement therewith, and said brackets of the springs at opposite edges of the joint being secured to the joint at such edges and to the adjacent structural member for movement therewith.

5. A composite expansion joint assembly as set forth in claim 3, wherein said spring brackets are generally L shaped and arranged in opposition, said spring members being positioned between the legs of said brackets extending lengthwise of said joint.

6. A composite expansion joint assembly as set forth in claim 1, wherein there are a plurality of sealing elements and structural members, said equalizing spring means being positioned in the space between support bar locations.

7. A composite joint assembly as set forth in claim 1 including a plurality of structural members wherein each of said structural members carries a spring bracket having oppositely disposed angular arms at opposite ends thereof, the arms of the brackets of adjacent structural members arranged in opposition, the spring members positioned between the opposed arms of said brackets, generally L-shaped brackets secured to the joint at opposite edges thereof and having arms in spaced opposition to said bracket arms extending toward the edge of the joint, and spring members positioned between each pair of opposed arms.

8. In a composite expansion joint assembly for a bridge roadway and the like, said joint being of the type having a pair of edge members adapted to define the opposite sides of the joint, a pair of elongated, resiliently yieldable sealing elements extending longitudinally of said groove in side-by-side relation, an elongated, rigid structural member interposed between said sealing elements and extending lengthwise of said groove, and laterally spaced support bars extending transversely of said groove, said sealing elements being adapted to resiliently expand and compress upon expansion and contraction, respectively, of the joint, the improvement which comprises equalizing spring means carried by the structural members for closing and opening upon expansion and contraction of the joint, said equalizing spring means exerting centering forces upon each structural member independently of said support bars and in opposition to expansion and compression of said sealing members, said equalizing spring means comprising a common spring bracket carried by said member and having angularly related arms at opposite ends thereof, generally L-shaped brackets secured to the joint at opposite ends thereof and having arms in spaced opposition to said common bracket arms, and a pair of spring members between said opposed arms.

9. In a composite expansion joint assembly for a bridge roadway and the like, said joint being of the type having a pair of edge members adapted to define the opposite sides of the joint, a plurality of elongated, resiliently yieldable sealing elements extending longitudinally of said groove in side-by-side relation, an elongated, rigid structural member interposed between adjacent sealing elements and extending lengthwise of said joint, and laterally spaced support bars extending transversely of said joint, said sealing elements being adapted to resiliently expand and compress upon expansion and contraction, respectively, of the joint, the improvement which comprises equalizing spring means carried by each structural member for closing and opening upon contraction and expansion of the joint, said equalizing spring means exerting centering forces upon each structural member independently of said support bars and in opposition to expansion and compression of said sealing members, said spring means comprising a resiliently yieldable solid member having a dowel extending therethrough and through openings in opposed legs of supporting brackets secured to the structural member and the opposite edges of the joint.

10. In a composite expansion joint assembly for a bridge roadway and the like, said joint being of the type having a pair of edge members adapted to define the opposite sides of the joint, a plurality of elongated, resiliently yieldable sealing elements extending longitudinally of said joint in side-by-side relation, an elongated, rigid structural member interposed between adjacent sealing elements and extending lengthwise of said joint, and laterally spaced support bars extending transversely of said joint, said sealing elements being adapted to resiliently expand and contract upon expansion and contraction, respectively, of the joint, the improvement which comprises equalizing spring means carried by each structural member for closing and opening upon contraction and expansion of the joint, said equalizing spring means exerting centering forces upon each structural member independently of said support bars and in opposition to opening and closing of said sealing members, said equalizing spring means comprising angle brackets supporting an interposed spring member in spaced relation below the structural member, together with a spacer member secured to the structural member and extending therebelow, one of said brackets being secured to said spacer member.

* * * * *

UNITED STATES PATENT AND TRADEMARK OFFICE

CERTIFICATE OF CORRECTION

PATENT NO. : 4,339,214

DATED : July 13, 1982

INVENTOR(S) : Guy S. Puccio and Robert J. Kogutek

It is certified that error appears in the above-identified patent and that said Letters Patent are hereby corrected as shown below:

Column 4, line 12, "said membes" should be -- end members --.

Column 4, line 50, "members" should be -- member --.

Column 5, line 34, delete "releasing".

Column 5, line 61, "of each" should be -- at each --.

Claim 8, column 9, line 13, "ends" should be -- edges --.

Signed and Sealed this

*Seventh* Day of *September 1982*

[SEAL]

*Attest:*

GERALD J. MOSSINGHOFF

*Attesting Officer*

*Commissioner of Patents and Trademarks*